US005511974A

United States Patent [19]

Gordon et al.

[11] Patent Number: 5,511,974

[45] Date of Patent: Apr. 30, 1996

[54] CERAMIC FOAM LOW EMISSIONS BURNER FOR NATURAL GAS-FIRED RESIDENTIAL APPLIANCES

[75] Inventors: Michael W. Gordon, Manheim; Mikhail Zlatkin, Lancaster; Kurt A. Bauer, Exton; Kurt D. Oswald, Hellam, all of Pa.

[73] Assignee: Burnham Properties Corporation, Wilmington, Del.

[21] Appl. No.: 326,915

[22] Filed: Oct. 21, 1994

[51] Int. Cl.[6] ..... F23D 14/14; F23D 14/16

[52] U.S. Cl. ..... 431/329; 431/328

[58] Field of Search ..... 431/7, 326, 328, 431/329, 170, 354

[56] References Cited

U.S. PATENT DOCUMENTS

| | | | |
|---|---|---|---|
| 3,251,356 | 5/1966 | Prince et al. | 431/329 X |
| 3,424,146 | 1/1969 | Patrick et al. | 431/329 X |
| 3,847,536 | 11/1974 | Lepage | 431/329 |
| 4,437,833 | 3/1984 | Mertz | 431/329 |
| 4,608,012 | 8/1986 | Cooper | 431/328 |
| 4,889,481 | 12/1989 | Morris et al. | 431/328 |
| 5,174,744 | 12/1992 | Singh | 431/326 X |
| 5,326,257 | 7/1994 | Taylor et al. | 431/329 |

FOREIGN PATENT DOCUMENTS

| | | | |
|---|---|---|---|
| 0187508 | 7/1986 | European Pat. Off. | 431/329 |

*Primary Examiner*—Carl D. Price
*Attorney, Agent, or Firm*—Haynes N. Johnson

[57] ABSTRACT

An atmospheric reticulated ceramic foam burner which is retrofittable into existing residential heat exchanger designs has been developed to reduce $NO_x$ and CO emissions. It is operated in a blue flame or substantially radiant mode. The ceramic foam tile used is a three dimensional, web-like structure composed of ceramic struts and voids (or pores) which is permeable and rigid and can withstand the high temperatures found in domestic burners. The foam tile is positioned over a manifold, and is the outlet for the manifold. The manifold inlet is a venturi so that incoming gas is mixed with air in the correct range of proportions before passing through the foam. The pressures used, relative to tile porosity, are such that the gas-air mixture does not burn until it has passed all the way through the foam tile, resulting in a flame above the tile. Additional quantities of (secondary) air can be introduced around the burner to mix and burnout the products of combustion. Thus, by the time of burning, the air-gas mixture has been thoroughly mixed so that the flame can provide complete combustion, thus reducing emissions.

In one modification of the invention one or more screens can be placed over the outlet of the foam tiles. In another modification, a series of holes pass through the tiles. Both modifications serve to further mix the air and gas before combustion.

12 Claims, 3 Drawing Sheets

CERAMIC FOAM LOW EMISSIONS BURNER FOR NATURAL GAS-FIRED RESIDENTIAL APPLIANCES

FIELD OF THE INVENTION

This invention relates to burners for residential appliances, and, in particular, to atmospheric or induced-draft, ceramic foam burners using ceramic foam for residential/commercial hydronics boilers. These burners can be retrofitted and obtain substantially complete combustion and, so, reduce air pollution.

BACKGROUND OF THE INVENTION

The widespread promulgation of emissions regulations across all categories of emitting sources presents unique challenges to residential appliances. Unlike commercial/industrial combustion sources which utilize and adapt decades of utility-scale emissions technologies in response to environmental regulations, residential appliances with atmospheric burners require totally different strategies for achieving significant emissions reductions.

The difficulties associated with developing low emissions atmospheric burner technology has led many manufacturers to adopt forced draft, fully premixed combustion methods. Although this is an effective approach to reducing $NO_x$ and CO emissions, such a solution is very expensive compared with the atmospheric burners they replace. Thus, the use of atmospheric or induced draft technology, when made feasible, can provide a competitive advantage over the present "forced draft" technologies. At the same time, low emissions atmospheric burners can serve as a bridge between current and future heat exchanger designs.

Ceramic foam burners in a forced draft, fully premixed radiant mode have been used in industrial heat treating and drying operations. Examples of such industrial burners will be found in Morris U.S. Pat. No. 4,889,481 and Singh U.S. Pat. No. 5,174,744. However, ceramic foam has not been used for atmospheric, or induced draft, low emissions burners.

BRIEF SUMMARY OF THE INVENTION

Reticulated ceramic foam, properly used, offers a novel solution to reducing $NO_x$ and CO emissions from residential burners; and we have successfully developed an atmospheric reticulated ceramic foam burner which is retrofittable into existing residential heat exchanger designs. Operated in a blue flame or substantially radiant mode, this technology can be integrated into existing heat exchanger designs without deleteriously affecting system performance.

The ceramic foam tile used is a three dimensional, web-like structure composed of ceramic struts and voids (or pores) which is permeable and rigid and can withstand the high temperatures found in domestic burners. In appearance, it closely resembles a sponge with uniform consistency.

The foam tile is positioned over a manifold, and is the outlet for the manifold. The manifold inlet is a venturi so that incoming gas is mixed with air in the correct proportions before passing through the foam. The pressures used, relative to tile porosity, are such that the gas-air mixture does not burn until it has passed all the way through the foam tile, resulting in a flame above the tile. Additional quantities of (secondary) air can be introduced around the burner to mix and burnout the products of combustion. Thus, by the time of burning, the air-gas mixture has been thoroughly mixed so that the flame can provide complete combustion, thus reducing emissions.

In one modification of our invention one or more screens can be placed over the outlet of the foam tiles. In another modification, a series of holes pass through the tiles. Both modifications serve to further mix the air and gas before combustion.

DETAILED DESCRIPTION OF THE INVENTION

Figure 1:
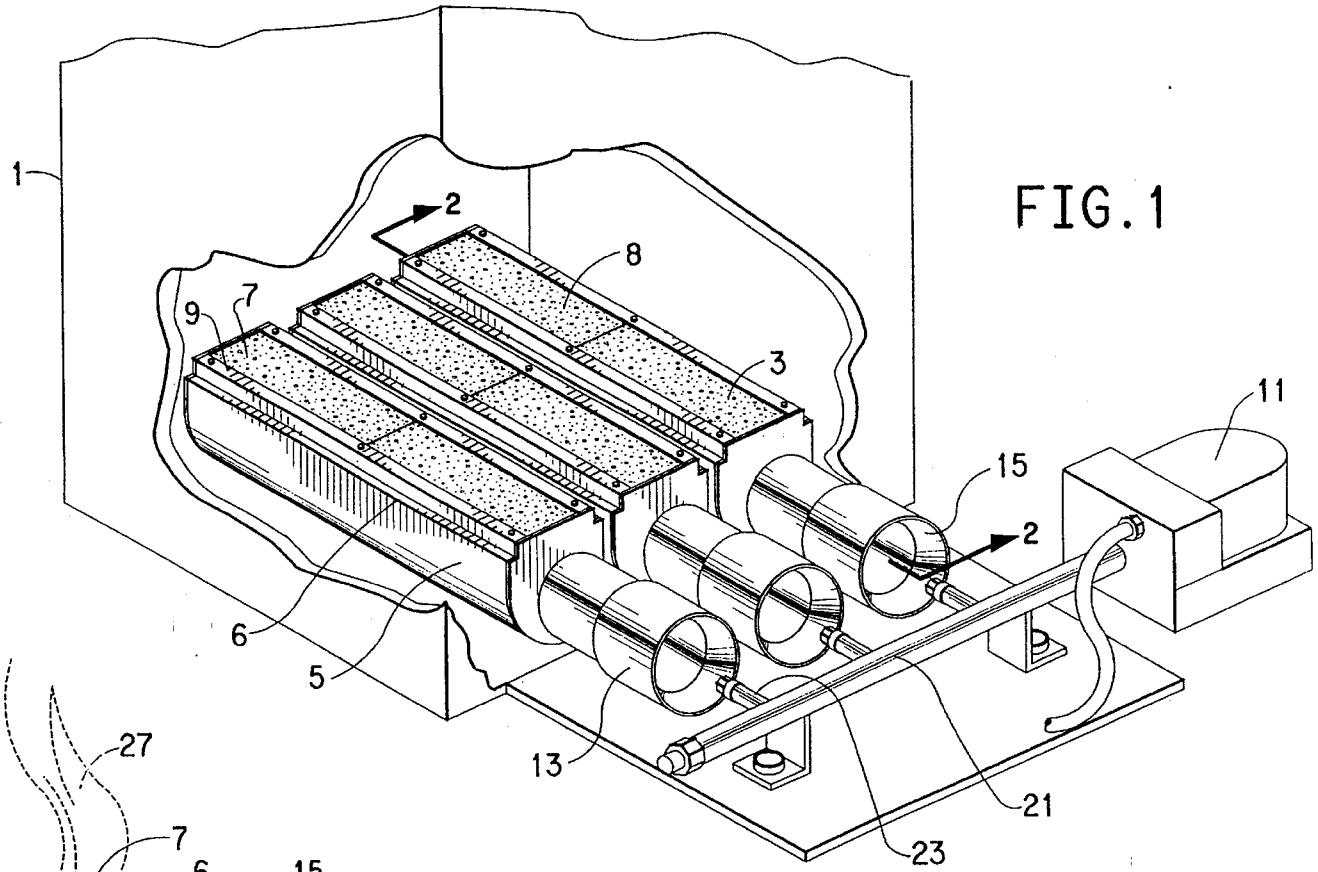
FIG. 1 is a perspective view of my burner as it would be positioned within a boiler.
Figure 2:
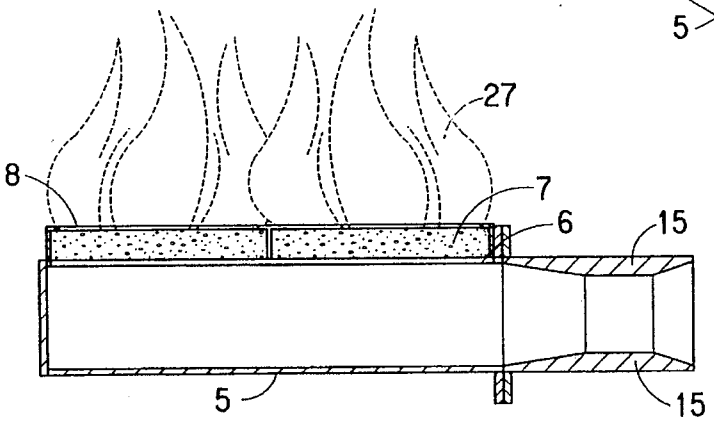
FIG. 2 is a vertical section, taken on line 2—2 of FIG. 1.

This invention uses ceramic foam tile in an atmospheric or induced draft burner, and operates it in a blue flame or substantially radiant mode. That is, the flame is outside of and above the foam, rather than within the foam; this results in low emissions being achieved without the use of forced draft. A high primary air concentration is combined with the gas and passed through the foam, with additional quantities of secondary air added downstream of the tile; and the systems of our invention serve to assure complete mixing of the air and gas before combustion.

Ceramic foam (also called "reticulated ceramic") is a three dimensional, web-like structure composed of ceramic struts and voids (or pores) which is both permeable and rigid. In appearance, it closely resembles a sponge with uniform consistency.

The foam can be manufactured from almost any ceramic compound, although silicon carbide, alumina and magnesium alumina silicate (cordierite) are the most common base materials. Base material selection is determined by the operational environment the structure is designed to withstand (maximum temperature, temperature variation, and atmosphere) and any performance requirements which are to be optimized (emissivity, erosion and thermal conductivity). In general, however, all ceramic foams, regardless of composition, exhibit excellent thermal properties, high surface area to mass ratios, low resistance to fluid flow, and high corrosion resistance.

Reticulated ceramics are prepared by coating a polyurethane foam (or similar material) with the desired ceramic compound. The coated foam is then heat treated in a high temperature industrial furnace where the polyurethane is volatilized from within the ceramic coating, and the remaining ceramic is bonded and cured. The final product is an engineered material that can be manufactured to exacting tolerances with respect to material properties, dimensions, shapes, and structure.

When used in a burner, such as that of the present invention, ceramic foam has a three dimensional, web-like structure with uniform porosity (designated as pores per inch, or ppi). It aids in mixing the gas and air, in increasing flame speeds, in increasing heat flux, and, so, in lowering pollutant emissions. In addition, it results in uniform surface temperature, good resistance to thermal shock, stable combustion with lean mixtures, and durability.

The preferred design for a retrofit burner 3 will fit into an existing jacket 1. Our atmospheric ceramic foam burner design includes two major components, a foam tile holder 6 and a venturi 13. It uses a manifold 5 carrying a ceramic tile holder 6, holding one or more blocks of ceramic foam tile 7, having, preferably 30 pores per inch (ppi). Metal supports 9 are used to bolt the foam in position. A gas valve 11 feeds gas through pressurized gas supply line 21 and nozzles 23 to the input 15 of venturi 13. The reduced throat 17 of the venturi serves to draw atmospheric air in to be mixed with the gas, forming an air-gas mixture which enters the manifold. This mixture is further mixed due to the delay within the manifold 5 and to the mixing which occurs in the ceramic foam tile 7. The foam tile has an external surface 8 through which all exiting mixture passes. The resulting flame 27 is outside the foam 7 and external surface 8, not within the foam.

This atmospheric ceramic foam burner 3 was developed with the goals of providing low $NO_x$ performance in a configuration suitable for retrofit into existing cast iron base, heat exchanger and jacket 1 assemblies. As can be seen from the figures, the tile holders 6 can be constructed of round mechanical tubing and flat steel stock, or cast in iron or other suitable material. The tile holder resembles a cylinder with the front open to guide the venturi. On the top of the cylinder is a rectangular ledge in which the tile 7 is secured with high temperature ceramic tape and a metal support 9 or other suitable sealing devices or materials.

One design which has proven satisfactory has tile holders dimensioned to accommodate two substantially rectangular ceramic tiles, each with a surface area of about 15 to 17 square inches, and a thickness of about ⅜ to ½ inch, and uses a venturi between 2 and 18 inches long with an inlet diameter between ½ and 3 inches and an outlet diameter of 1 to 4 inches. The use of a large tile served to reduce heat flux (heat release per unit surface area) and pressure drop. It also aided residence time within the holder. The mixture of gas and air in the venturi should be between about 0.6 and 2 times the quantity of air relative to gas that is required for stoichiometric combustion. It has been found that the total heat flux should be between about 10,000 and 50,000 Btuh (BTU per hour) per tile for this design, corresponding to about 600 and 3,000 Btuh/in$^2$; that the pressure drop in the tile should be no greater than about 1 inch of water column; and that the residence time of the gas-air mix in the tile should be at least 0.01 sec.

By meeting these criteria it was found that CO and $NO_x$ were reduced to satisfactory levels. Thus, with an input rate of between 10,000 and 50,000 Btuh for each tile holder, $NO_x$ emission levels were reduced to 20 ppm and CO levels were reduced to 100 ppm. By contrast, attempts to boost the input rate above 50,000 Btuh per tile holder resulted in significant increases in CO emissions and a two-or three-fold increase in $NO_x$ levels.

By operating in an atmospheric mode, rather than a forced draft mode, it has become possible to reduce emission levels substantially for domestic heaters without deleteriously affecting system performance.

Figure 3:
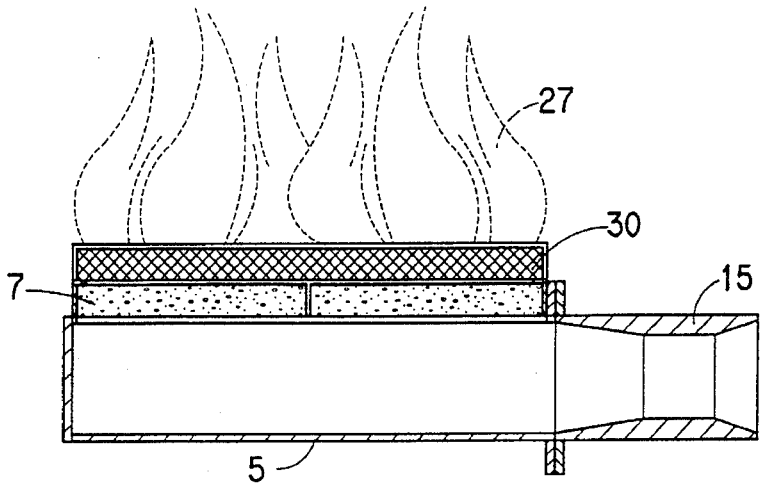
FIG. 3 is similar to FIG. 2, showing a modification in which a screen is placed over the foam tile outlet.
Figure 4:
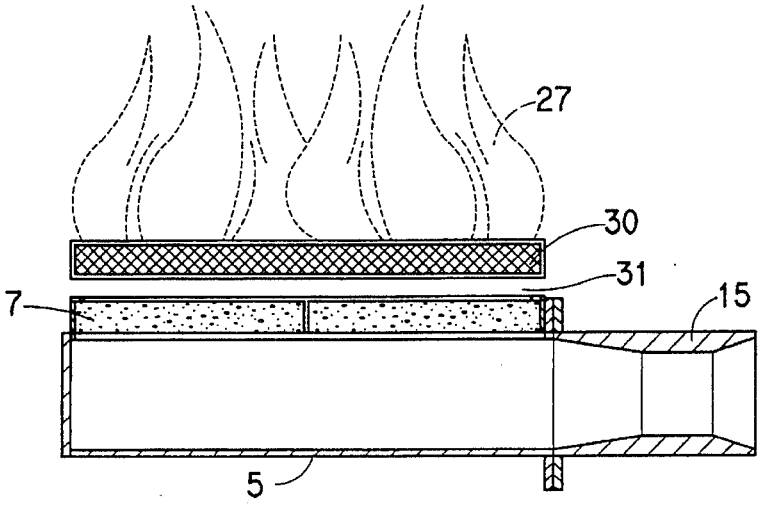
FIG. 4 is similar to FIG. 3, except that the screen is spaced from the tile.

Two modifications provide for changes in the foam usage to cause even more thorough mixing of the air and gas before combustion. In the first modification (FIGS. 3 and 4) one or more stainless steel screens 30 are placed over the foam 7. These can be fitted directly on top of the foam outlet (FIG. 3) or be spaced 31 (FIG. 4) between 1/16 and 2 inches from it. In either case, the screen serves to delay and turbulate combustion for additional time, and, so, enhance mixing and significantly reduce $NO_x$ and CO emissions. The screens have openings in them of between one-eighth to one-half inch, and preferably between one-eighth and one-quarter inch.

Figure 5:
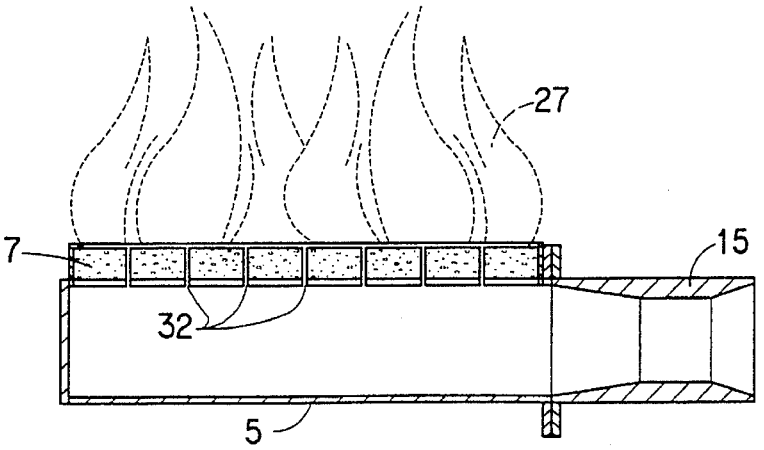
FIG. 5 is similar to FIG. 2, showing a second modification in which ports run through the tiles.
Figure 6:
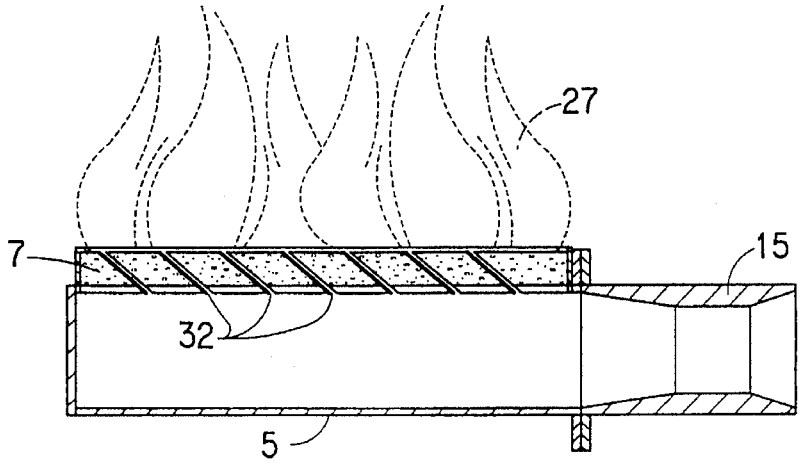
FIG. 6 is similar to FIG. 5, except that the ports are shown angled.

In the second modification (FIG. 5), vertical holes or ports 32 run through the foam tiles at a selected angle θ from the vertical, and serve to reduce pressure drop through the tiles. Angle θ can be between 0° and about 85° from the vertical, as shown in FIG. 6. These holes should be between one-sixteenth and three-eighths inch in diameter, and we have found it best to have between 5 and 50 holes through each of the two tiles.

It has been found that, by using the structures of our invention, significant reductions in polluting emissions can be obtained without the necessity of using forced draft.

We claim:

1. A burner for retrofitting residential appliances having reduced $NO_x$ and CO emissions, said burner including a manifold having an inlet area and an outlet area, a venturi leading into said inlet area, means for supplying gas under low pressure, of about 3½ inches water column, and air at atmospheric pressure to said venturi, whereby said gas and said air are combined in said venturi to form an air-gas mixture, ceramic foam tile covering said outlet area, said ceramic foam tile having an external surface, whereby said air-gas mixture passes through said ceramic foam tile for further mixing and out through said external surface, and mixing means for positively increasing mixing of said air-gas mixture after said mixture has passed through said ceramic foam tile and out through said external surface, and prior to burning said air-gas mixture, said mixing means being a screen positioned proximate to, but spaced from, said external surface such that secondary air is added to said air-gas mixture.

2. A burner as set forth in claim 1 in which said venturi, said manifold, and said ceramic foam tile are dimensioned such that the total heat flux provided by said burning air-gas mixture is between about 600 and 3,000 Btuh/in$^2$ proximate to said external surface.

3. A burner as set forth in claim 2 in which said heat flux does not exceed about 3,000 Btuh/in$^2$ proximate to said external surface.

4. A burner as set forth in claim 1 in which said screen is spaced from said external surface between about 1/16 and 2 inches.

5. A burner as set forth in claim 1 including a plurality of ports passing through said ceramic foam tile, said ports being between 1/16 and ⅜ inch diameter, said ports increasing turbulence of said air-gas mixture and permitting operation of said burner at said low pressure.

6. A burner as set forth in claim 5 in which said ports are at an angle of between 0° and about 85° from the vertical to said external surface.

7. A burner as set forth in claim 1 in which the pressure drop in said air-gas mix as it passes through said ceramic foam tile does not exceed 1 inch water column.

8. A burner for residential appliances having reduced $NO_x$ and CO emissions, said burner including a manifold having an inlet area and an outlet area, a venturi leading into said inlet area, said venturi with an inlet diameter between ½ and 3 inches and an outlet diameter of 1 to 4 inches, means for supplying gas under low pressure, of about 3½ inches water column, and air at atmospheric pressure to said venturi, whereby said gas and said air are combined in said venturi to form an air-gas mixture with a ratio of air to gas of between about 0.6 to about 2.0 stoichiometric, ceramic foam tile covering said outlet area, said ceramic foam tile having an external surface, whereby said air-gas mixture passes through said ceramic foam tile for further mixing and out through said external surface, the volume of said air-gas mixture being such that the heat flux produced by burning said air-gas mix is between about 600 and 3,000 Btuh/in$^2$, and mixing means for adding secondary air to said air-gas mixture after said mixture has passed through said ceramic foam tile and out through said external surface, and prior to burning said air-gas mixture.

9. A burner as set forth in claim 8 in which said mixing means for adding secondary air to said air-gas mixture is a screen positioned proximate to, but spaced from, said external surface of said ceramic foam tile.

10. A burner as set forth in claim 8 in which the pressure drop in said air-gas mixture as it passes through said ceramic foam tile does not exceed 1 inch water column.

11. A burner as set forth in claim 8 in which said ceramic foam tile has ports passing therethrough, there being sufficient said ports so that pressure drop of said gas-air mixture in passing through said ceramic foam tile is no greater than about 1 inch of water column.

12. A burner as set forth in claim 8 in which said ceramic foam tile has about 30 ppi.

* * * * *